United States Patent [19]

Schiel et al.

[11] 4,033,049

[45] July 5, 1977

[54] APPARATUS FOR CHANGING THE MOISTURE CONTENT OF PAPER WEBS OR THE LIKE

[75] Inventors: Christian Schiel, Heidenheim-Schnaitheim; Hans Flämig, Heidenheim (Brenz), both of Germany

[73] Assignee: J. M. Voith GmbH, Heidenheim (Brenz), Germany

[22] Filed: Dec. 19, 1974

[21] Appl. No.: 535,049

[30] Foreign Application Priority Data

Dec. 22, 1973 Germany ..... 2364346

[52] U.S. Cl. ..... 34/115; 34/117

[51] Int. Cl.[2] ..... F26B 13/08

[58] Field of Search ..... 34/114, 115, 117, 120, 34/122, 159; 162/290

[56] References Cited

UNITED STATES PATENTS

| | | | |
|---|---|---|---|
| 2,303,123 | 11/1942 | Johannessen | 34/115 X |
| 3,089,252 | 5/1963 | Daane et al. | 34/114 |
| 3,110,575 | 11/1963 | Justus | 34/114 X |
| 3,418,723 | 12/1968 | Burgess et al. | 34/1 |
| 3,727,325 | 4/1973 | Fleissner et al. | 34/115 |
| 3,816,941 | 6/1974 | Halik et al. | 34/117 X |
| 3,874,997 | 4/1975 | Kankaanpää | 34/115 X |
| 3,891,500 | 6/1975 | Kankaanpää | 34/122 X |

FOREIGN PATENTS OR APPLICATIONS

| | | | |
|---|---|---|---|
| 93,022 | 10/1938 | Switzerland | 34/122 |

*Primary Examiner*—William F. O'Dea
*Assistant Examiner*—Harold Joyce
*Attorney, Agent, or Firm*—Michael J. Striker

[57] ABSTRACT

A drying apparatus for wet paper webs which employs a rotary drum having a foraminous cylindrical wall and being located between but spaced apart from two parallel drying rolls with foraminous or impermeable cylindrical walls. The major part of the drum is surrounded by a hotair hood, and an endless wire screen is trained over the rolls as well as over that part of the drum which is surrounded by the hood. The screen forms a loop which surrounds a stationary suction chamber extending into the space between the rolls and having an open side facing the drum as well as the spaces between the drum and the rolls. The suction chamber has one or more sealing strips which are closely adjacent to the screen upstream of the first roll (as considered in the direction of transport of a web) and downstream of the second roll. The leader of the web is threaded between the screen and the first roll, thereupon around the drum between the screen and the hood, and finally between the screen and the second roll.

15 Claims, 4 Drawing Figures

SOURCE OF HOT AIR 8A
8
22
4
13'
1
5A
20
13A
6A
21'
22
6
5
16'
7
18
24A
16
II
17
19
15
12
21
14
13B
9
23
11
13
II
2
10
3
24

APPARATUS FOR CHANGING THE MOISTURE CONTENT OF PAPER WEBS OR THE LIKE

BACKGROUND OF THE INVENTION

The present invention relates to improvements in apparatus for changing the moisture content of paper webs or the like, especially for reducing the moisture content of wet paper webs in paper making machines. More particularly, the invention relates to improvements in drying apparatus for paper webs or the like wherein the web directly contacts the peripheral surface of two cylindrical roll-shaped dryers and it trained around a hollow drum which is disposed between the dryers and has a perforated cylindrical wall, and wherein a portion of an endless screen consisting of wire mesh or the like is disposed between the cylindrical wall of the drum and the web.

German Offenlegungsschrift No. 2,315,792 discloses a web drying apparatus wherein the drum is a suction drum and the dryers have perforated cylindrical walls whose orifices discharge streams of a hot gaseous drying medium. The first dryer (as considered in the direction of movement of the web) cooperates with an auxiliary belt which maintains the web in contact with the endless screen and further serves as a means for transferring the web onto the drum. To this end, the first dryer is in direct contact with the drum. Such construction is not entirely satisfactory because the web must pass through the nip of the first dryer and the drum whereby the resulting pressure affects the quality of the web. The just described drying apparatus further comprises a blower which is located downstream of the second dryer and serves as a means for separating the treated web from the peripheral surface of the second dryer. The second dryer is also in direct contact with the drum, i.e., the paper web must pass through the nip of the first dryer and the drum as well as through the nip of the drum and the second dryer. Such mode of reducing the moisture content is not satisfactory in connection with the making and treatment of high-quality papers. Moveover, the apparatus is quite expensive because it employs three devices which discharge a compressed hot gaseous fluid, namely the two dryers and the aforementioned blower.

U.S. Pat. No. 3,418,723 to Burgess et al. discloses an apparatus which establishes turbulent conditions in the area where a hot gas contacts the paper web. The web is in direct contact with the suction drum and with two rolls which flank the drum and serve as a means for facilitating the threading of the leader of a paper web through the drying apparatus. In addition, the rolls are in sealing engagement with neighboring portions of a hot-air hood which surrounds the suction drum. The suction drum confines centrally located means for withdrawing moisture-laden air and stationary means for sealing off that portion of the drum which is not surrounded by the paper web. The turbulent gas which is drawn into the suction drum subjects the paper web to extremely high tensional stresses which often lead to breakage of the web. Furthermore, the threading of the leader of the web into and through the apparatus is complex and time-consuming, even if the apparatus is equipped with the aforementioned endless screen. Moreover, the paper web is likely to adhere to the peripheral surfaces of the rolls (rather than to advance with the screen); this results in undesirable elongation of the web with attendant reduction of quality and increased likelihood of web breakage.

SUMMARY OF THE INVENTION

An object of the invention is to provide an apparatus which can change the moisture content of relatively thin and weak webs consisting of paper or the like without adversely affecting the appearance, strength and/or other desirable characteristics of the webs.

Another object of the invention is to provide a novel and improved apparatus for drying paper webs which is simpler and more economical than heretofore known apparatus.

A further object of the invention is to provide a drying apparatus for thin and lightweight paper webs.

An additional object of the invention is to provide a drying apparatus which can be rapidly anc conveniently converted for treatment of relatively wide or relatively narrow paper webs, wherein a paper web can be treated in one or more stages, and wherein the paper web or selected portions thereof can be subjected to a more or less intensive drying action.

Still another object of the invention is to provide a novel and improved system of drums, rolls, rollers, suction chambers and hot-air boxes for use in apparatus for changing the moisture content of webs which consist of paper or other fibrous material. The improved apparatus is utilized for changing the moisture content of webs which are advanced lengthwise in a predetermined direction, particularly for reducing the moisture content of wet paper in paper making machines. The apparatus comprises parallel first and second cylindrical rolls which are closely adjacent to each other, a hollow rotary drum having a foraminous cylindrical wall and being parallel with, closely adjacent to and disposed between the rolls, and an endless permeable screen consisting of wire mesh or the like and having a first portion trained over a portion of the first roll, a second portion trained over the major portion of the drum, a third portion trained over a portion of the second roll, and a large loop which is defined by several rollers. The apparatus further comprises a suction chamber which is disposed within the loop and has an open side adjacent to that portion of the drum which is not surrounded by the screen. The suction chamber further comprises one or more sealing strips one of which may be placed close to the screen upstream of the first roll and another of which can be placed close to the screen downstream of the second roll. The paper web can be advanced by driving the screen, on or both rolls and/or the drum. During threading of a fresh paper web into the apparatus, the leader of the fresh web is caused to advance between the first portion of the screen and the first roll, thereupon around the second portion of the the screen, and finally between the second roll and the third portion of the screen.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
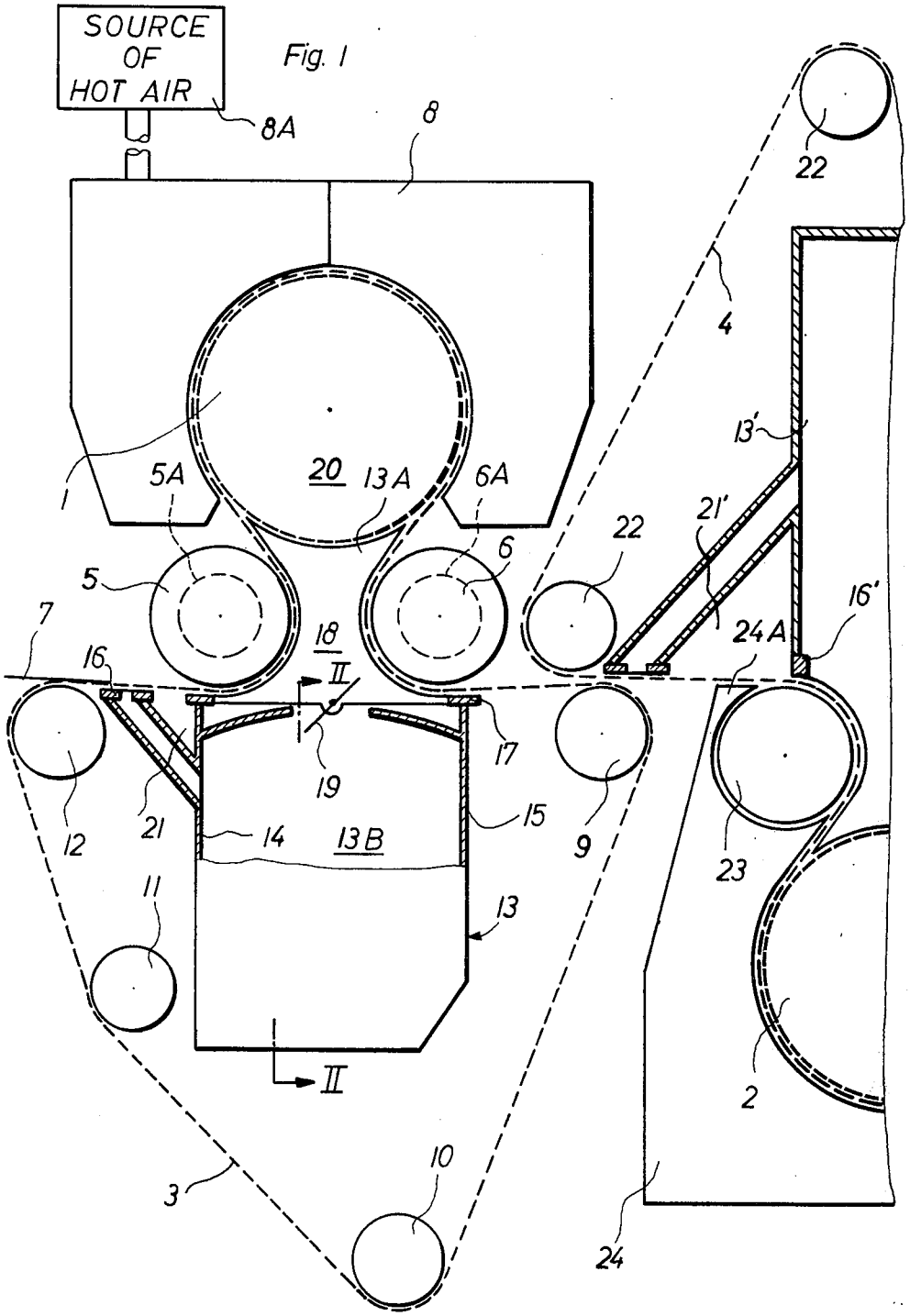
FIG. 1 is a fragmentary schematic partly elevational and partly vertical sectional view of an apparatus which embodies one form of the invention.
Figure 2:
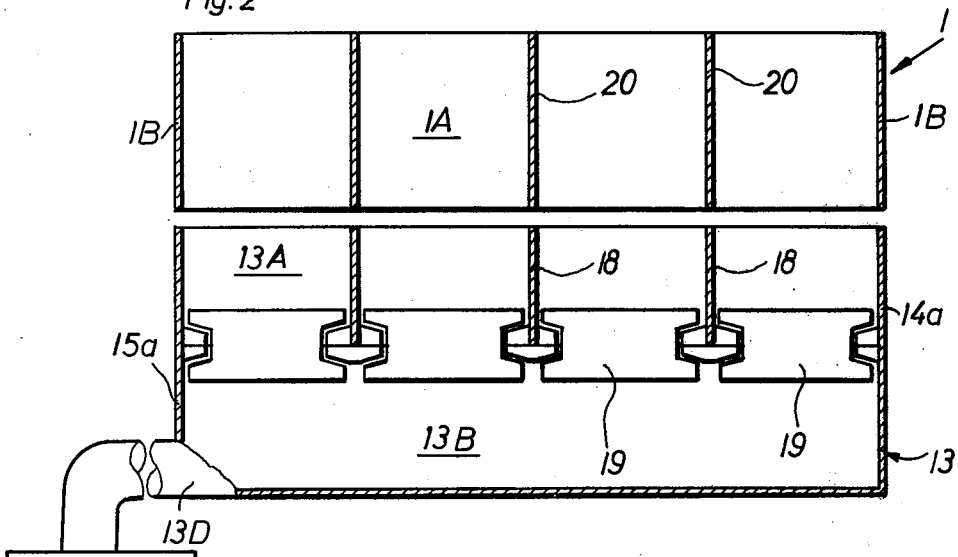
FIG. 2 is a smaller-scale sectional view as seen in the direction of arrows from the line II—II of FIG. 1.

The apparatus of FIGS. 1 and 2 is a multi-stage drying apparatus. The first stage comprises a hollow drum 1 which is rotatable about a horizontal axis and is disposed between and at a level above two heated rotary cylindrical roll-shaped contact dryers 5 and 6 (hereinafter called rolls). The axes of the rolls 5, 6 are located in a common horizontal plane and are parallel to the axis of the drum 1. The heating means for the rolls 5, 6 are indicated at 5A, 6A. An endless screen 3 is trained around approximately three-quarters of the peripheral surface of the perforated cylindrical wall of the drum 1, around portions of the rolls 5, 6, and around a set of guide rollers 9, 10, 11 and 12 located at a level below the rolls.

The screen 3 directly contacts the peripheral surfaces of the rollers 9-12 and drum 1 but is normally out of contact with the rolls 5, 6 because a wet paper web 7 is caused to pass through the first stage in such a way that it overlies the screen 3 between the guide roller 12 and roll 5, thereupon directly contacts the smooth cylindrical peripheral surface of the roll 5, thereupon passes around that portion of the screen 3 which is in direct contact with the peripheral surface of the drum 1, thereupon passes between the screen 3 and the smooth cylindrical peripheral surface of the roll 6, and finally advances above the screen 3 intermediate the roll 6 and guide roller 9 to enter the second stage of the drying apparatus. The peripheral surfaces of the rolls 5, 6 are closely adjacent to but still spaced apart from the peripheral surface of the drum 1, and the rolls 5, 6 are closely adjacent to each other. In FIG. 1, the shortest distance between the peripheral surfaces of the rolls 5, 6 is substantially less than the radius of the drum 1, and the distance between the peripheral surfaces of the drum 1 and roll 5 or 6 is less (e.g., one-half) the distance between the rolls. The diameter of the drum 1 exceeds the diameters of the rolls 5, 6 and these rolls are heated from within to expel moisture from the paper web 7. The major part of the drum 1 (namely that part which is surrounded by the screen 3) is surrounded by a hot-air hood 8. The means 8A for supplying hot air to the hood 8 is of conventional design.

That portion of the screen 3 which surrounds the guide rollers 9-12 forms a large loop which spacedly surrounds a suction chamber 13. The side walls 14, 15 of the suction chamber 13 are respectively provided with sealing strips 16, 17 which are closely adjacent to the underside of the screen 3 between the roller 12 and roll 5 (strip 16) and between the roller 9 and roll 6 (strip 17). The upper surfaces of the sealing strips 16, 17 are immediately adjacent to but preferably do not contact the undersides of the neighboring portions of the screen 3. The length of the suction chamber 13 equals or closely approximates the width of the drying apparatus, i.e., the axial length of the rolls 5, 6 and drum 1.

As shown in FIG. 2, the interior of the upper portion of the suction chamber 13 is subdivided into several (e.g., four) compartments 13A by vertical partitions 18 which are parallel to the plane of FIG. 1 and to the two end walls 14*a*, 15*a* of the suction chamber. The partitions 18 are located in that portion of the suction chamber 13 which extends into the space between and above the rolls 5, 6. The upper side of this portion of the suction chamber 13 is open so that the latter can draw moisture-laden air from the interior of the drum 1 when the apparatus is in use. The lower portion 13B of the suction chamber 13 is connected with a suction generating device 13E by way of a suction pipe or outlet 13D which evacuates moisture-laden air. Each compartment 13A can be partially or completely sealed from the lower portion 13B by a discrete valve 19 (e.g., a butterfly valve which is turnable about a horizontal axis extending at right angles to the plane of FIG. 1). In this manner, an attendant can reduce the effective width of the suction chamber 13 if the width of the paper web 7 is less than the axial length of the drum 1. The latter is formed with disk-shaped internal partitions 20 each of which is preferably in register with or close to a partition 18 in the upper portion of the suction chamber 13. For example, if the width of the paper web 7 equals the combined width of the two median compartments 13A shown in FIG. 2, and the web 7 is advanced in such a way that it overlies the two median compartments, the two outer valves 19 are closed so that the suction generating device need not draw air into the two outermost compartments 13A. The compartments of the drum 1 are shown at 1A.

The sealing strip 16 extends upwardly and outwardly from the side wall 14 and bounds an elongated section 21 of the suction chamber 13. This section 21 extends along the full length of the roll 5 between the locus where the strip 16 is nearest to the screen 3 and the locus where the paper web 7 comes into contact with the roll 5.

The second stage of the drying apparatus comprises a hollow drum 2 which is analogous to the drum 1, two dryers or rolls 23 (only one shown) each of which is hollow and has a perforated cylindrical wall, a suction chamber 13′ which is located above the drum 2 and has two sealing strips (only the strip 16′ shown), and an endless screen 4 which is trained over the drum 2, rolls 23 and a set of guide roller 22 (only two shown). The main difference between the two stages is that the drum 2 is located at a level below the rolls 23, that the suction chamber 13′ is located above the drum 2, and that the hot-air hood 24 for the drum 2 has two extensions 24A (only one shown) each of which has an open side surrounding that portion of the respective roll 23 which is not in contact with the paper web 7 (or with the screen 4 when the trailing end of the web 7 has been advanced beyond the second stage).

The left-hand roller 22 of FIG. 1 is located at a level above that portion of the screen 3 which extends between the roll 6 and the roller 9 so that the screen 4 can guide the web 7 into the second stage in the region between the left-hand roller 22 and the roll 23 of FIG. 1. The underside of the suction chamber 13′ is open toward the adjacent portion of the drum 2 as well as toward the adjacent portions of the rolls 23 so that the chamber 13′ can draw hot air from the box 24 not only through the perforations in the cylindrical wall of the drum 2 but also through the perforations of the cylindrical walls of the rolls 23. The elongated section of the suction chamber 13′ is shown at 21′.

It will be noted that the screens 3 and 4 contact the opposite sides of a web 7 which is threaded through the two stages of the drying apparatus.

An advantage of the drying apparatus is that the suction chamber 13 or 13′ is located within the confines of the loop which is formed by the screen 3 or 4 opposite the drum 1 or 2. The suction chambers produce uniform subatmospheric pressure along the full width of the respective stages of the drying apparatus. Thus, there is no need to provide auxiliary suction generating means in the drum 1 or 2, in the rolls 5, 6 of the first stage and/or in the (additional) rolls 23 of the second stage. Furthermore, each suction chamber enhances the transport of a web along the respective screen. Still further, and referring by way of example to the first stage, air which is being drawn into the open side of the upper portion of the suction chamber 13 in the space between the roll 5 and drum 1 insures that the web 7 is separated from the periphery of the roll 5 and enters the space between the hood 8 and drum 1. Analogously, the open side of the upper portion of the suction chamber 13 draws air through the space between the drum 1 and roll 6 to thus insure that the leader of the web 7 will adhere to the outer side of the respective portion of the screen 3 and will enter the space between the screen 3 and the periphery of the roll 6.

The section 21 of the suction chamber 13 extends from the sealing strip 16 to that portion of the screen 3 which is flexed by the roll 5. The upper wall of the section 21 prevents suction in the chamber 13 from flexing the screen portion above the section 21. Moreover, suction in the section 21 is effective at the underside of the screen 3 well ahead of the locus where the screen reaches the roll 5.

The partitions 18 and valves 19 in the upper portion of the suction chamber 13 are desirable and advantageous but optional. Thus, if the partitions 20 and end walls 1B properly seal the compartments 1A of the drum 1 from each other, a relatively narrow web 7 can be properly dried if it overlies only two of the four compartments 1A; however, the suction chamber 13 will then draw air through the other two compartments 1A and such air will not remove any moisture from the material to be treated.

The valves 19 enable an attendant to vary the pressure in the compartments 13A at will. Thus, and if the nature of the web to be treated is such that the web requires more intensive drying along its marginal portions and less intensive drying in the median portion (or vice versa), the valves 19 can be readily adjusted so as to allow for the flow of larger quantities of air from the hood 8, through the respective compartment or compartments 1A of the drum 1, and into the registering compartment or compartments 13A in the upper portion of the suction chamber 13.

In many instances (and as described in connection with the rolls 5, 6), the rolls may be provided with impermeable cylindrical walls which are heated by electric or other suitable heating means to contribute to the drying action. However, if the web 7 is very porous, the rolls may be provided with foraminous cylindrical walls (as described in connection with the roll 23).

The placing of the left-hand roller 22 of FIG. 1 above the rightmost portion of the loop which is formed by the screen 3 renders it possible to extend the section 21′ of the suction chamber 13′ all the way to a locus above the roller 9. Thus, the pressure differential at the opposite sides of the screen 4 between the left-hand roller 22 and the roll 23 of FIG. 1 insures that the web 7 leaves the screen 3 at 9 and thereupon advances with the underside of the screen 4 from the left-hand roller 22 toward the peripheral surface of the roll 23.

The web 7 may be advanced lengthwise by driving one or more rollers for the screens 3, 4, by driving one or both rolls 5, 6 or 23, and/or by driving the drums 1, 2.

Figure 3:
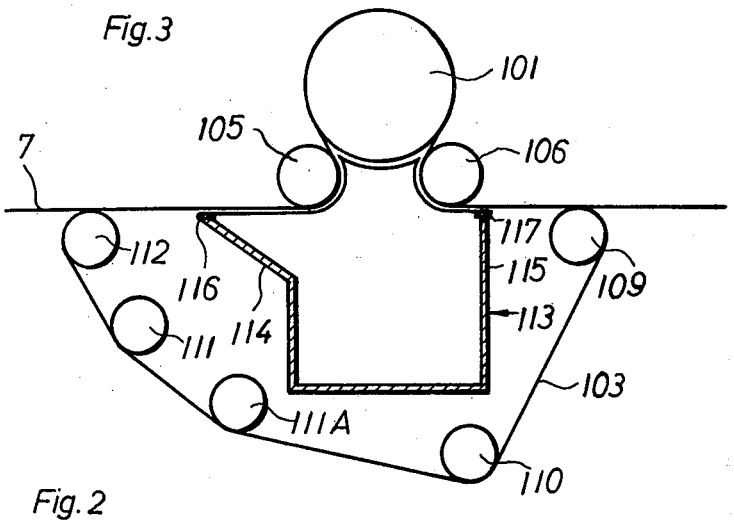
FIG. 3 is a fragmentary schematic partly elevational and partly vertical sectional view of a second apparatus.

FIG. 3 illustrates a structure which may constitute a complete drying apparatus or one stage of a multistage apparatus. The suction chamber 113 does not have a section 21 or 21′ and its interior is not or need not be subdivided into compartments, i.e., the suction chamber 113 draws air from the perforations along the full length of the drum 101. All such parts of the apparatus of FIG. 3 which are identical with or clearly analogous to the corresponding parts of the first stage of the apparatus shown in FIG. 1 are denoted by similar reference characters plus 100. The screen 103 forms a loop which surrounds the suction chamber 113 and is defined by the rolls 105, 106 as well as five guide rollers 109, 110, 111, 111A and 112.

Figure 4:
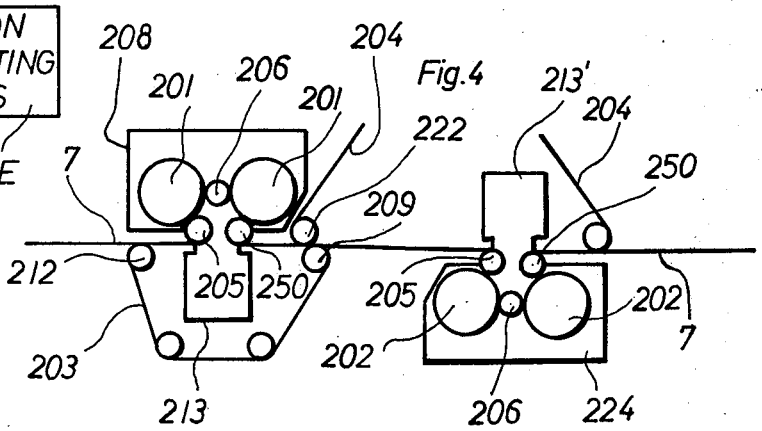
FIG. 4 is a schematic elevational view of a third apparatus.

FIG. 4 shows two stages of a third drying apparatus wherein each stage comprises two drums 201 or 202 and three roll-shaped contact dryers 205, 206, 250. Each roll 206 is disposed between the respective drums 201 or 202, i.e., each drum 201 or 202 is again disposed between two rolls 205, 206 or 206, 250. the web 7 passes through the first stage by advancing above the screen 203 between the roller 212 and roll 205, thereupon directly in contact with the cylindrical peripheral surface of the roll 205, thereupon around that portion of the screen 203 which surrounds the left-hand drum 201, thereupon directly in contact with the peripheral surface of the roll 206, thereupon around that portion of the right-hand drum 201 which is surrounded by the screen 203, thereupon directly in contact with the peripheral surface of the roll 250, and finally along the upper side of that portion of the screen 203 which extends between the roll 250 and the roller 209. The leftmost roller 222 of the second stage again overlies the screen 203 between the roll 250 and roller 209. The hot-air box for the first stage is shown at 208 and the suction chamber at 213. The second stage is similar to but turned through 180 degrees with respect to the first stage. FIG. 4 merely shows the suction chamber 213′, the hot-air hood 224, and a portion of the screen 204. The rolls 205, 206, 250 in the second stage have perforated cylindrical walls, the same as the roll 23 of FIG. 1. The placing of the leftmost roller 222 above the rightmost portion of the screen 203 facilitates the transport of a web 7 from the first stage into the second stage.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an apparatus for changing the moisture content of webs which are advanced lengthwise in a predetermined direction, particularly for reducing the moisture content of paper webs, a combination comprising parallel first and second cylindrical rolls; a hollow rotary drum having a foraminous cylindrical wall, said drum being parallel with, closely adjacent to and disposed between said rolls said drum further comprising a pair of end walls and at least one partition disposed between said end walls and subdividing the interior of said drum into a plurality of compartments; and endless permeable screen having first, second and third portions respectively trained around said first roll, said drum and said second roll and directly contacting the peripheral surface of said drum, said screen further having a loop; and suction chamber disposed within said loop and having a portion disposed between said rolls and provided with an open side facing the peripheral surface of said drum intermediate said rolls, said chamber further having at least one second partition located in and subdividing said portion of said chamber into a plurality of second compartments each in register with one of said first mentioned compartments, a web to be treated being threaded between said first screen portion and said first roll, around said second screen portion, and between said third screen portion and said second roll, and said suction chamber having sealing means adjacent to said screen ahead of said first portion thereof, as considered in said direction.

2. A combination as defined in claim 1, wherein said suction chamber has a section adjacent to said first portion of said screen.

3. A combination as defined in claim 1, further comprising a hot-air hood having an open side adjacent to said second portion of said screen.

4. A combination as defined in claim 3, wherein said open side of said hood is further adjacent to at least one of said first and third portions of said screen.

5. A combination as defined in claim 1, wherein said suction chamber has an outlet remote from said open side and further comprising valve means provided in said chamber and movable between a plurality of positions in one of which at least one of said second compartments is at least substantially sealed from said outlet.

6. A combination as defined in claim 5, wherein said suction chamber further comprises a second portion which is free of partitions and communicates with said outlet, said valve means being disposed between said second portion of said chambers and said one second compartment.

7. A combination as defined in claim 1, wherein at least one of said rolls has a heated cylindrical wall which is impermeable to fluids.

8. A combination as defined in claim 1, wherein at least one of said rolls has a foraminous cylindrical wall.

9. A combination as defined in claim 1, wherein said drum is disposed intermediate but out of contact with said first and second rolls.

10. A combination as defined in claim 1, wherein said first portion of said screen forms with said first roll a line of initial contact at which it passes onto said first roll, and said third portion of said screen forms with said second roll a line of terminal contact at which it passes off said second roll.

11. A combination as defined in claim 10, wherein said sealing means are located upstream of said line of initial contact; said suction chamber further having additional sealing means adjacent to said screen downstream of said line of terminal contact.

12. A combination as defined in claim 1, further comprising a third roll parallel to said first and second rolls and a second drum disposed between said second and third rolls, said second drum being parallel to said rolls and said screen having a fourth portion trained over said second drum and a fifth portion trained over said third roll, said second and third rolls being closely adjacent to said second drum and to each other and said suction chamber having a portion extending between said second and third rolls close to said second drum and having an open side facing said second drum.

13. A combination as defined in claim 12, wherein the web to be treated surrounds said fourth portion of said screen and extends between said third roll and said fifth portion of said screen, and further comprising a plurality of rollers, said loop of said screen being trained over said rollers.

14. A combination as defined in claim 1, further comprising first and second additional rolls, an additional drum between said additional rolls, an additional screen having first, second and third portions respectively trained around said first additional roll, said additional drum and said second additional roll, the web to be treated extending from between said third portion of said first mentioned screen and said second roll toward and between said first portion of said additional screen and said first additional roll, thereupon around said second portion of said additional screen, and then between said second additional roll and said third portion of said additional screen, and an additional suction chamber extending between said additional rolls and having an open side facing said additional drum intermediate said additional rolls, said additional drum having a foraminous cylindrical wall.

15. A combination as defined in claim 14, wherein said first and second screens contact the opposite sides of a web which is trained over said first and second rolls and around said first and second additional rolls.

* * * * *